United States Patent [19]

Maki

[11] 4,039,436

[45] Aug. 2, 1977

[54] SPIRAL CLASSIFIER HAVING PRIMARY AND SECONDARY COARSE SOLIDS FRACTION DISCHARGE

[75] Inventor: Richard R. Maki, Hibbing, Minn.

[73] Assignee: United States Steel Corporation, Pittsburgh, Pa.

[21] Appl. No.: 646,138

[22] Filed: Jan. 2, 1976

[51] Int. Cl.[2] ..... B03B 5/52

[52] U.S. Cl. ..... 209/464; 209/494

[58] Field of Search ..... 209/461–464, 209/490, 494, 448–450; 210/525, 523

[56] References Cited

U.S. PATENT DOCUMENTS

| | | | |
|---|---|---|---|
| 2,621,791 | 12/1952 | Bitzer | 209/464 X |
| 2,933,187 | 4/1960 | Old et al. | 209/464 |

FOREIGN PATENT DOCUMENTS

| | | | |
|---|---|---|---|
| 53,859 | 10/1890 | Germany | 209/464 |

*Primary Examiner*—Frank W. Lutter
*Assistant Examiner*—Ralph J. Hill
*Attorney, Agent, or Firm*—John F. Carney

[57] ABSTRACT

The dryness of the coarse solids fraction discharged from a spiral classifier is improved by the provision of a secondary coarse particles discharge in the side wall of the classifier tank upstream of the primary coarse particles discharge. Part of the coarse fraction is removed from the process stream through the secondary discharge thereby relieving the load on the raking mechanism and facilitating the liberation of entrained free moisture from the coarse material remaining in the classifier tank.

7 Claims, 3 Drawing Figures

SPIRAL CLASSIFIER HAVING PRIMARY AND SECONDARY COARSE SOLIDS FRACTION DISCHARGE

BACKGROUND OF THE INVENTION

In the operation of conventional spiral classifiers for the separation of ore or sand particles according to particle size water is introduced together with the material to be processed as a slurry mixture into an elongated classifier tank. The classifier tank is an upwardly inclined, trough-like apparatus whose upper end is open and whose lower end is closed by a weir plate. A raking mechanism in the from of a motor-driven spiral-ribbon extends along the length of the tank to agitate the process material and to induce movement of the coarse fraction deposited on the floor of the tank generally in the direction of the upper end of the tank. Although solids separation is affected by several factors it is primarily dependent upon the time redquired for the particles to gravitate to the bottom of the liquid pool within the tank such that the coarse solids fraction is discharged from the upper, open end of the tank while the fine solids fraction passes over the weir plate at the lower end thereof.

In the application of spiral classifiers for the size separation of the tailings from certain ore beneficiating processes undesirable results have been obtained in that the coarse fraction discharged from the apparatus contains undue amounts of free mositure. The large amounts of liquid contained in the discharge excessively burdens the conveying system which conducts the material discharge to storage hoppers from which it is loaded onto trucks for ultimate disposal. It further potentially causes problems in the motor and drive systems of the trucks used to carry the material as well as increasing the maintenance requirements on the conveyor systems and the pocket seals employed in both the trucks and the storage hoppers. Lastly, it increases the bulk density required to be handled by both the trucks and the conveyor systems with an attendant increase in the cost of operating the processing system.

It is to the improvement of the operation of such spiral classifiers therefore that the present invention is directed.

SUMMARY OF THE INVENTION

The aforementioned disadvantages attendant with comparable prior art classifiers are overcome by the herein-described invention which involves spiral classifier apparatus for the classification of solid particles in a liquid-solids mixture comprising plate means defining longitudinally extending, oppositely spaced side walls froming an elongated tank, inlet means for supplying a mixture of liquid and solids particles to the interior of said tank; a primary coarse solids discharge at one end of said tank and a fine solids discharge at the other end thereof; a raking mechanism operative in said tank for inducing movement of the coarse solids fraction toward said coarse solids discharge; and means forming an opening provided in said side walls intermediate said inlet means forming a secondary coarse solids discharge for the removal of part of the coarse solids fraction ahead of said primary coarse solids discharge.

It is accordingly a principle object of the invention to provide a spiral classifier characterized by increased effectiveness when compared with similar apparatus of the prior art.

It is another object of the present invention to provide apparauts of the described type that is capable of delivering a coarse solids fraction containing reduced amounts of free moisture as compared with prior art classifiers.

Another object of the present invention is to provide a spiral classifier in which the loading on the raking mechanism is reduced thereby giving rise to a concomitant reduction in operating costs.

For a better understanding of the invention, its operating advantages and the specific objectives obtained by its use, reference should be made to the accompanying drawings and description which relate to a preferred embodiment thereof.

DESCRIPTION OF THE PREFERRED EMBODIMENT

Figure 1:
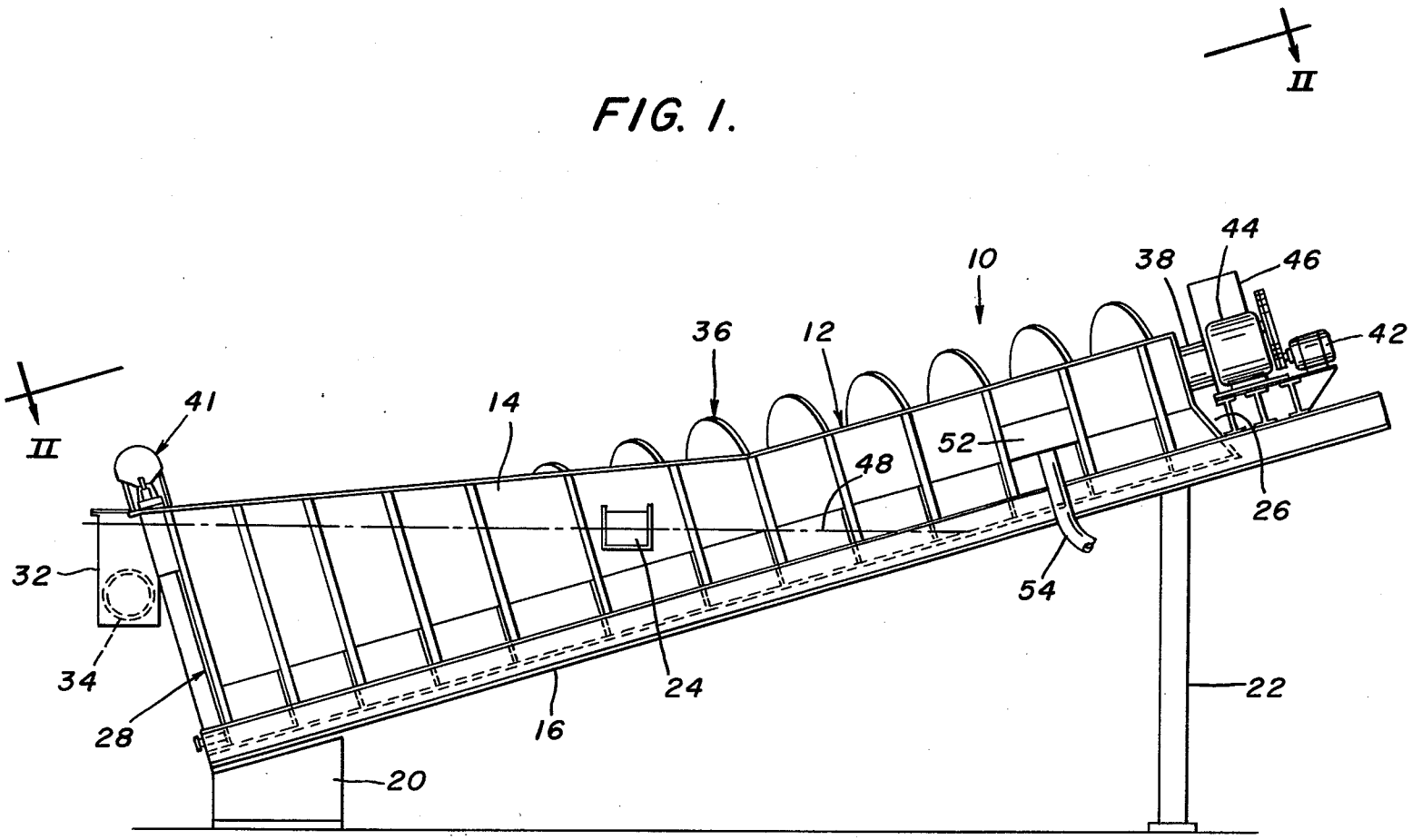
FIG. 1 is an elevational representation of a spiral classifier according to the present invention.

The several drawing figures illustrate a spiral classifier 10 comprising an elongated tank 12 defined by oppositely spaced, divergent side walls 14 and 15 that are supported on rectangularly arranged structural members 16 and 18 which form a bed frame surrounding the bottom of the tank. The bed frame is disposed on footings 20 and 22 that incline the tank upwardly from end to end in its operative position. A feed inlet opening 24 is provided in one side wall approximately midway along the length of the tank 12 to supply a slurry mixture of liquid and particulate solid material to the tank interior for processing. The upper end of the tank 12 is open to provide at 26 a discharge for the coarse fraction of the process material. The lower end of the tank is closed by an end wall 28 whose upper edge is provided with means for mounting a series of removable slats 30 tht define an adjustable weir which regulates the division between the coarse and fine fractions in a manner well known in the art. Plate means defining a collector compartment 32 having a discharge conductor pipe 34 is attached to the lower end wall 28 and adapted to receive and conduct away the liquid and the entrained fine particle fraction which has been separated from the process material.

Mounted for operation within the classifier tank 12 is a raking mechanism 36 comprising an axle shaft 38 that is substantially coextensive with the tank and which is jounaled for rotation therewithin. The axle shaft 38 supports a plurality of spiral vanes 40, here shown as being in the form of a doulbe helix, which operate to induce movement of the material deposited on floor of the tank upwardly toward the coarse material discharge opening 26. The raking mechanism 36 is driven by an electric motor 42 through appropriate reduction gearing 44 that attaches one end of the axle shaft 38, the latter being journaled in an antifriction radial and thrust bearing 46 and all of which being supported on the bed frame adjacent the discharge opening 26. The other end of the axle shaft 38 is journaled in a vertically adjustable bearing 39 having a fluid actuator 41 for raising the raking mechanism as is well known in the art.

The operation of the apparatus thus far described is conventional and is described as follows in connection with the classification according to size of particulate solids material, such as tailings from an ore beneficiating process. A slurry mixture of water and ore tailings is admitted to the interior of the classifier tank 12 where the slurry mixture is allowed to pool, the water component together with the entrained solid particles therein assuming a level substantially as indicated by the phantom line 48. Depending on several factors such as the angle of inclination of the tank 12; its length; or the height of rear wall 26 of the heavier or coarser solids particles in the mixture will gravitate to the bottom of the tank leaving the finer particles entrained in the liquid. Thus, the particulate fines which represent the fine fraction of the solids mixture will be caused to overflow the weir into the collector compartment 32 for removal through the conductor pipe 34. The heavier or coarse fraction of the mixture which has settled to the bottom of the tank 12 is induced by rotation of the spiral raking mechanism 36 upwardly toward and out of the open end 26 of the tank where the particles fall onto a belt conveyor, or the like (not shown) for conveyance to a location for further processing or ultimate disposal.

Figure 2:
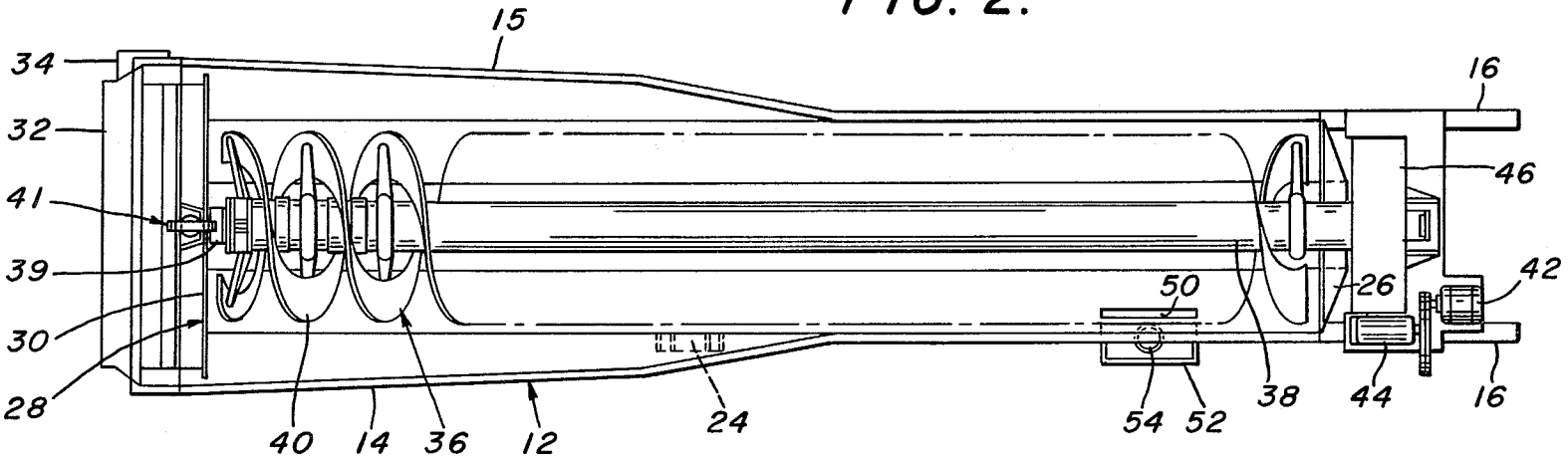
FIG. 2 is a plan view of the spiral classifier taken along line II–II of FIG. 1.
Figure 3:
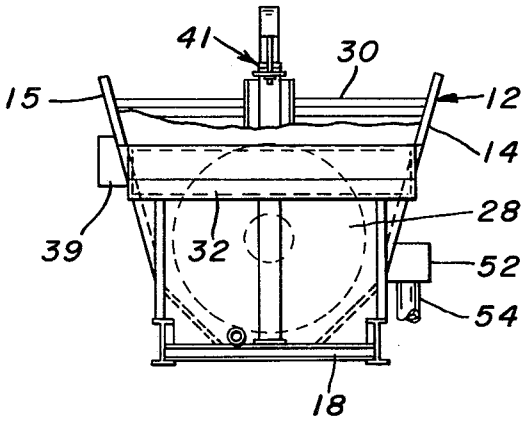
FIG. 3 is an end view of the spiral classifier of FIG. 1.

According to the present invention means are provided to reduce the amount of free moisture contained in the coarse material fraction that is discharged from the opening 26. Such means comprises a secondary discharge opening 50 provided in that side wall 14 of the tank 12 adjacent which the spiral vanes 40 of the raking mechanism 36 move in an upward direction. The secondary discharge opening 50 is located above the maximum level expected to be attained by the water and may be limited in longitudinal extent as shown in FIGS. 1 and 2 herein or may extend completely to the upper end 26 of the tank. The opening 50 is enclosed by plate means forming a collector compartment 52 having a conductor pipe 54 extending thereform for disposal of that part of the coarse fraction material that is passed through the opening 50.

From the foregoing description it will be appreciated that, as the spiral vanes 40 move upwardly along the side wall 14 the coarse articles are caused to mound or build up along this wall and in so doing reach a location in the vicinity of the opening 50 where a significant portion is lifted above the water level 48. Any free moisture contained in the particles raised out of the water pool is caused to gravitate away from the particles and some of these now drier particles are permitted to pass out of the tank 12 through the secondary discharge opening 50 thereby relieving the load on the raking mechanism as represented by that amount of coarse particles that must be conveyed the full extent of the tank to the primary discharge opening 26. By relieving the load on the raking mechanism 36 more coarse particles are permitted to be raised up by the rotating spiral vanes 40 thereby liberating more free moisture from the particles.

These results, therefore, a significant reduction in the amount of free moisture contained in the coarse particle fraction discharged from the classifier. This reduction in free moisture content of the coarse particle fraction is similar to that which could otherwise be achieved only by increasing significanlty the length of the apparatus. An improved effectiveness of moisture separation is thus achieved at a reduced expense of capital equipment and at lower operating costs.

It will be understood that various changes in the details, materials and arrangements of parts which have been herein described and illustrated in order to explain the nature of the invention, may be made by those skilled in the art within the principle and scope of the invention as expressed in the appended claims.

I claim:

1. Spiral classifier apparatus for the classification of solids particles in a liquid - solids mixuture comprising:

a. longitudinally extending side walls and a bottom inclined upwardly from end to end forming an elongated tank;

b. inlet means for supplying a mixture of liquid and solids particles to the interior of said tank forming a pool therein;

c. a primary coars solids discharge at the elevated end of said tank and a fine solids discharge at the other end thereof, the level of said fine solids discharge defining the level of said pool;

d. a raking mechanism operative in said tank for inducing movement of the coarse solids fraction toward said coarse solids discharge; and e. means froming an opening in one of said side walls adjacent said raking mechansim and intermediate said inlet and said primary coarse solids discharge and disposed above the level of said pool to define a secondary coarse solids discharge for the removal of part of the coarse solids fraction ahead of said primary coarse solids fraction

2. Apparatus as recited in claim 1 in which said raking mechanism comprises rotatable spiral vanes and means for rotating the same.

3. Apparatus as recited in claim 2 in which said secondary coarse solids discharge opening is disposed in that side wall of said tank adjacent which said spiral vanes move upwardly.

4. Apparatus as recited in claim 3 including plate means forming a collector compartment enclosing said secondary coarse solids discharge opening and means for conducting material discharged into said compartment away therefrom.

5. Apparatus as recited in claim 3 in which said one end of said tank is open to define said primary coarse solids discharge.

6. Apparatus as recited in claim 3 in which said other end of said tank is closed by an upstanding rear wall the upper edge of which forms a weir defining said fine solids discharge.

7. Apparatus as recited in claim 6 including removable plates forming the upper edge of said rear wall for adjusting the position of said weir.

* * * * *

UNITED STATES PATENT OFFICE

CERTIFICATE OF CORRECTION

Patent No. 4,039,436 Dated August 2, 1977

Inventor(s) Richard R. Maki

It is certified that error appears in the above-identified patent and that said Letters Patent are hereby corrected as shown below:

Column 1, line 56, change "froming" to -- forming --.

Column 2, line 44, change "tht" to -- that --.

Column 2, line 55, change "jounaled" to -- journaled --.

Column 3, line 59, change "These" to -- There --.

Column 4, line 23, claim 1.c., change "coars" to -- coarse --.

Column 4, line 30, claim 1.e., change "froming" to -- forming --.

Column 4, line 36, claim 1.e., change "fraction" to -- discharge. --.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*